US009869953B2

(12) United States Patent
Kaino et al.

(10) Patent No.: US 9,869,953 B2
(45) Date of Patent: Jan. 16, 2018

(54) IMAGE FORMING APPARATUS

(71) Applicant: CANON KABUSHIKI KAISHA, Tokyo (JP)

(72) Inventors: Toshiya Kaino, Suntou-gun (JP); Jun Asami, Susono (JP); Ryuichi Umehara, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/415,043

(22) Filed: Jan. 25, 2017

(65) Prior Publication Data

US 2017/0227897 A1 Aug. 10, 2017

(30) Foreign Application Priority Data

Feb. 5, 2016 (JP) ..... 2016-020762

(51) Int. Cl.
*G03G 15/20* (2006.01)

(52) U.S. Cl.
CPC ..... *G03G 15/2028* (2013.01)

(58) Field of Classification Search
USPC ..... 399/38, 67, 68, 316, 322, 323
See application file for complete search history.

(56) References Cited

U.S. PATENT DOCUMENTS 5,771,434 A * 6/1998 Hokari ..... G03G 15/2028 399/303
9,244,395 B2 * 1/2016 Takagi ..... G03G 15/2028

FOREIGN PATENT DOCUMENTS

| | | | |
|---|---|---|---|
| JP | H05107966 | A | 4/1993 |
| JP | H07234604 | A | 9/1995 |
| JP | 2006023655 | A | 1/2006 |
| JP | 2006349837 | A | 12/2006 |
| JP | 4136392 | B2 | 8/2008 |

* cited by examiner

*Primary Examiner* — Hoan Tran
(74) *Attorney, Agent, or Firm* — Rossi, Kimms & McDowell LLP

(57) ABSTRACT

The image forming apparatus, a conveyance speed of a recording material at a fixing nip portion, controlled by a control portion of the image forming apparatus so that a part of the recording material being conveyed touches a guide member between a transfer nip portion and a loop detection device for a period after an operation for maintaining a loop amount of the recording material being conveyed within a predetermined range is finished until the recording material trailing edge exits out the transfer nip portion.

14 Claims, 7 Drawing Sheets

IMAGE FORMING APPARATUS

BACKGROUND OF THE INVENTION

Field of the Invention

The present invention relates to an image forming apparatus such as a copying machine and a printer for which an electrophotography method or an electrostatic recording method is employed.

Description of the Related Art

In an electrophotography type image forming apparatus, when a difference in a conveyance speed of a recording material occurs between a transfer nip portion and a fixing nip portion, defective images can be generated in some cases.

That is, since a temperature of a fixing roller or a pressure roller of the fixing nip portion fluctuates due to a number of passing recording materials or a number of passage times, a thermal expansion amount changes depending on a situation and appears as a change in an outer diameter. Thus, the conveyance speed of the recording material at the fixing nip portion changes, and a difference from the conveyance speed of the recording material occurs at the transfer nip portion.

If the conveyance speed of the fixing nip portion is faster than the conveyance speed of the transfer nip portion, the recording material is pulled by the fixing nip portion between the fixing nip portion and the transfer nip portion, and there is a concern that a disturbance can occur in an image when an unfixed image on an image bearing member is to be transferred to the recording material at the transfer nip portion.

On the other hand, if the conveyance speed of the recording material by the fixing nip portion is slower than the conveyance speed of the recording material by the transfer nip portion, the recording material begins to sag between the fixing nip portion and the transfer nip portion. The state where the recording material sags as above will be described below as "the recording material forms a loop". When the recording material forms a loop as described above, if the loop becomes too large, the recording material might be strongly pressed on and rubbed by a conveyance guide for guiding conveyance of the recording material between the transfer nip portion and the fixing nip portion. Moreover, if the loop is excessively formed, the recording material waves between the transfer nip portion and the fixing nip portion and can be rubbed by a ceiling of a conveyance path. As a result, the unfixed image transferred on the recording material is disturbed, and a defective image is generated.

Thus, the following proposal as below is made that the defective image is suppressed by causing a predetermined loop to be formed between the transfer nip portion and the fixing nip portion and by preventing the recording material from being pulled or sagging by that.

That is, a loop detection sensor for detecting a loop amount of the recording material and a loop detection flag for turning ON/OFF the loop detection sensor are provided on a conveyance guide between the fixing nip portion and the transfer nip portion. Then, according to a detection result of the loop detection sensor, the conveyance speed of the fixing nip portion is switched to a first speed slower than the conveyance speed of the transfer nip portion and a second speed faster than the conveyance speed of the transfer nip portion, and the loop amount is maintained within a predetermined range. By means of this loop control, while the recording material is sandwiched/conveyed by both the transfer nip portion and the fixing nip portion, image can be formed while the loop amount is held substantially constant (Japanese Patent Application Laid-Open No. H05-107966 and Japanese Patent Application Laid-Open No. H07-234604).

However, since the loop amount between the transfer nip portion and the fixing nip portion is substantially constant at all times, if a size of this loop is set large, for example, a recording material trailing edge might bounce by stiffness of the recording material in some cases when a recording material railing edge exits out the transfer nip portion. By means of this bouncing of the recording material, there is a concern that an image surface of the recording material might be rubbed by a conveyance path ceiling or the like, and a defective image is incurred.

In order to solve this problem of bouncing of the recording material trailing edge, a technology is proposed that the size of the loop of the recording material is set constant and image formation is performed, and the conveyance speed of the fixing nip portion is switched so that the loop of the recording material is decreased at predetermined timing before the recording material trailing edge passes through the transfer nip portion. As a result, the recording material trailing edge passes through the transfer nip portion in a state where the loop of the recording material is small, and bouncing of the recording material trailing edge is prevented (Japanese Patent No. 4136392).

However, various media need to be handled in response to market needs, and handling of image formation on thicker cardboards is also in demand. On the other hand, size reduction of an image forming apparatus is in demand, and new problems occur in a course of handling of these problems.

FIGS. 8A and 8B illustrate explanatory views of an attitude of a recording material P between a transfer nip portion N1 and a fixing nip portion N2. FIGS. 8A and 8B are for describing the problem of the present invention and do not illustrate conventional examples. Therefore, the same reference numerals are given to the same constituent portions as those of the embodiment of the present invention. In promoting size reduction of an apparatus, the transfer nip portion N1 and the fixing nip portion N2 needs to be brought closer to each other. By bringing the distance between the transfer nip portion N1 and the fixing nip portion N2 closer to each other, when the recording material P conveyed from the transfer nip portion N1 is curled or the like, a recording material leading edge cannot be easily introduced into the fixing nip portion N2 stably and smoothly.

In order to stably introduce even the curled recording material P into the fixing nip portion, an angle A formed by a nip tangential line Lt of the transfer nip portion N1 and a nip tangential line Lf of the fixing nip portion N2 needs to be designed larger than the conventional. By constituting as above, the recording material leading edge can easily follow a conveyance guide 73, and the recording material leading edge can be stably introduced into the fixing nip portion N2. In such an apparatus, when a cardboard is to be fed, at a moment when the recording material trailing edge Pe exits out the transfer nip portion N1, the recording material trailing edge Pe cancels the loop vigorously toward the nip tangential line Lf by rigidity (stiffness) of the recording material P (see FIG. 8A). As a result, the recording material trailing edge Pe is slapped onto the conveyance guide 73, an unfixed image in the vicinity of the recording material trailing edge is disturbed, and a defective image might occur in some cases (see FIG. 8B).

Therefore, since the larger a thickness of the recording material P is, the higher the rigidity becomes, a force to cancel the loop of the recording material gets stronger, and the defective image can occur more easily. Moreover, the closer the distance between the transfer nip portion N1 and the fixing nip portion N2 is, and the larger the angle A formed by the nip tangential line Lt of the transfer nip portion N1 and the nip tangential line Lf of the fixing nip portion N2 is, the force to cancel the loop of the recording material gets strong, and the defective image can occur more easily, which is a problem.

Moreover, as in Japanese Patent No. 4136392, even if control for reducing the loop of the recording material is executed before the recording material trailing edge Pe exits out the transfer nip portion N1, in the case of the cardboard, the loop is to be canceled by rigidity of the recording material toward a tangential line direction of the nip tangential line Lf of the fixing nip portion N2. Therefore, the recording material trailing edge Pe is slapped onto the conveyance guide 73, and occurrence of a defective image cannot be suppressed.

SUMMARY OF THE INVENTION

An object of the present invention is to provide an image forming apparatus which can stabilize a behavior at a moment when a recording material trailing edge exits out a transfer nip portion and can suppress occurrence of a defective image.

Another object of the present invention is to provide an image forming apparatus comprising: an image bearing member; a transfer member forming a transfer nip portion together with the image bearing member and transferring a toner image borne by the image bearing member onto a recording material while the recording material is conveyed at the transfer nip portion; a fixing unit disposed on a downstream side in a conveyance direction of the recording material with respect to the transfer nip portion and fixing the toner image onto the recording material while the recording material is sandwiched and conveyed at the fixing nip portion; a guide member provided between the transfer nip portion and the fixing nip portion and guiding the recording material to the fixing nip portion; a loop amount detection device provided between the transfer nip portion and the fixing nip portion and detecting a loop amount of the recording material in a state where the recording material being conveyed strides over both the transfer nip portion and the fixing nip portion; and a control portion for controlling a conveyance speed of the recording material at the fixing nip portion based on a detection signal of the loop amount detection device, the control portion controlling the conveyance speed of the recording material at the fixing nip portion so that the loop amount of the recording material is maintained within a predetermined range, wherein during a period after an operation for maintaining the loop amount of the recording material being conveyed within the predetermined range is finished and until a recording material trailing edge exits out the transfer nip portion, the control portion controls the conveyance speed of the recording material at the fixing nip portion so that a part of the recording material touches the guide member between the transfer nip portion and the loop detection device.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

By referring to the attached drawings, an exemplary embodiment for practicing the present invention will be described below in detail based on an embodiment.

Embodiment 1

(1) Image Forming Apparatus

Figure 1:
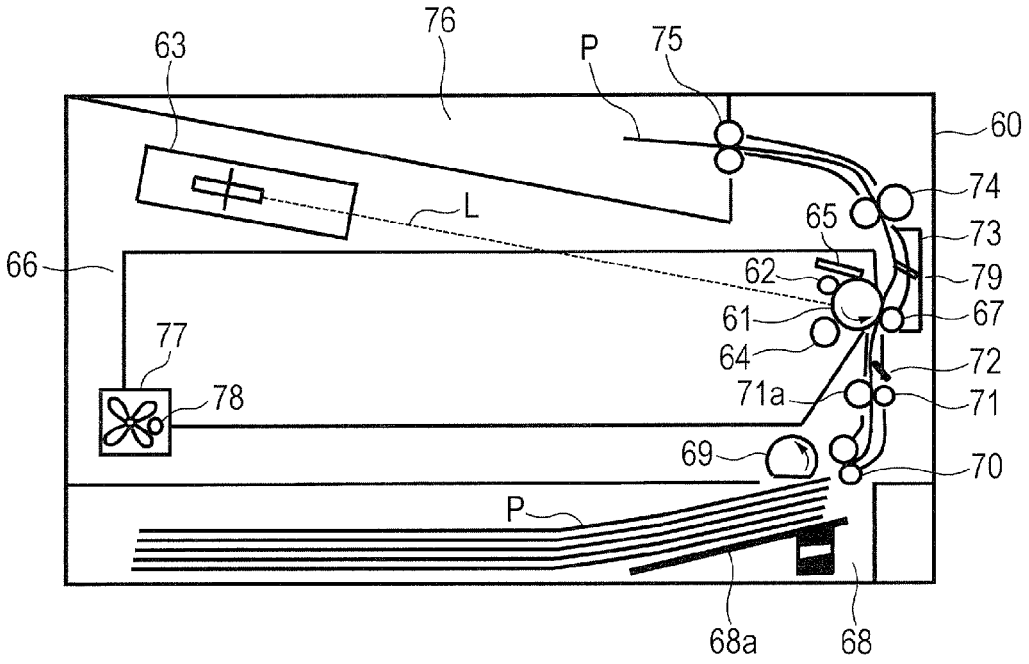
FIG. 1 is a sectional view of an image forming apparatus according to an embodiment of the present invention.

FIG. 1 is a configuration diagram of an image forming apparatus of an embodiment of the present invention. This image forming apparatus is an electrophotography type laser printer and forms an image according to image information input from an external device (not shown) such as a host computer on a recording material.

An image forming apparatus 60 illustrated in this embodiment rotates/drives a drum-shaped electrophotography photosensitive body (hereinafter referred to as a photosensitive drum) 61 as an image bearing member in an arrow direction at a predetermined speed (process speed) when a print instruction is input from an external device. The photosensitive drum 61 has an outer circumferential surface (surface) of the photosensitive drum 61 uniformly charged with a predetermined polarity/potential by a charger 62. Onto a charged surface on the surface of the photosensitive drum 61, image information is written by a laser scanner 63 as an exposure unit. The laser scanner 63 outputs a laser beam L modulated according to a signal of the image information input to the printer from the external device. Then, the laser scanner 63 scans/exposes the charged surface of the photosensitive drum 61 by the laser beam L.

As a result, an electrostatic latent image according to the image information is formed on the surface of the photosensitive drum 61. The electrostatic latent image is developed as a toner image (developing agent image) by a developer 64 using a toner (developing agent). The toner image on the surface of the photosensitive drum 61 is sent by rotation of the photosensitive drum 61 to the transfer nip portion N1 between the surface of the photosensitive drum 61 and an outer circumferential surface (surface) of a transfer roller (transfer member) 67 disposed opposite to the surface of this photosensitive drum 61. This is the constitution of an image forming portion.

On the other hand, recording materials P stacked on a sheet stacking table 68*a* of a feeding cassette 68 are picked up one by one by a feeding roller 69 driven at predetermined control timing and sent to a registration portion by a conveyance roller pair 70. At the registration portion, a leading edge of the recording material P is stopped once at a nip portion between a registration roller 71 and a roller 71*a*, and skew correction of the recording material P is carried out. Moreover, a registration sensor 72 is disposed in the registration portion, and reaching timing of the recording material leading edge and trailing edge and a length of the recording material are detected. After that, the recording material P is fed from the registration portion to the transfer nip portion N1. Image formation is performed so that a leading edge portion of the toner image on the photosensitive drum 61 reaches the transfer nip portion N1 at timing when a leading edge portion of the recording material P reaches the transfer nip portion N1 by detecting the recording material leading edge by the registration sensor 72.

The recording material P having been fed to the transfer nip portion N1 is sandwiched/conveyed by the photosensitive drum 61 and the transfer roller 67. Then, the toner image on the surface of the photosensitive drum 61 is transferred to the recording material P by a transfer bias applied to the transfer roller 67 in a conveyance process of the recording material P. The recording material P separated from the surface of the photosensitive drum 61 is conveyed to a heat fixing apparatus 74 along the conveyance guide 73.

Figure 2:
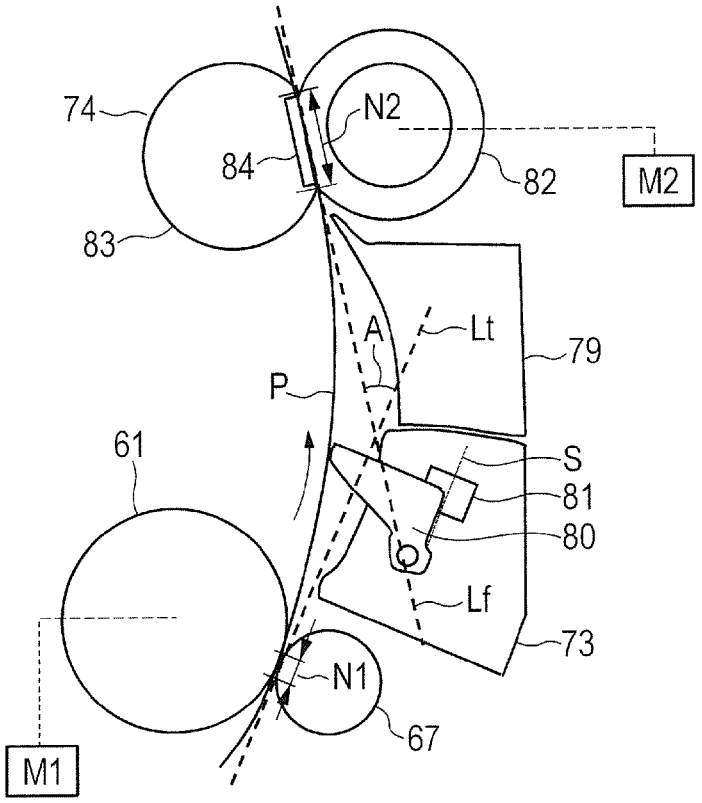
FIG. 2 is a schematic view of a cross section between a transfer nip portion and a fixing nip portion of the image forming apparatus according to the embodiment.

The heat fixing apparatus (fixing unit) 74 has a ceramic heater 84 which is a plate-shaped heat generating source, a thin endless belt-shaped fixing film 83 and a pressure roller 82. In FIG. 2, the ceramic heater 84 is pressed onto the pressure roller 82 through the fixing film 83 by a predetermined force. As a result, a fixing nip portion N2 is formed. By applying heat and a pressure by the fixing nip portion N2 to the recording material P bearing an unfixed toner image, the unfixed toner image is heat-fixed to the recording material P, and the recording material P is discharged from the fixing nip portion N2. The recording material P discharged from the fixing nip portion N2 of the heat fixing apparatus 74 is conveyed to a discharge roller 75. And the discharge roller 75 discharges the recording material P onto a discharge tray 76. On a surface of the photosensitive drum 61 after the recording material P has been separated therefrom, a transfer residual toner is removed by a cleaner 65 and is repeatedly offered for image formation.

The image forming apparatus 60 of this embodiment integrates the photosensitive drum 61, the charger 62, the developer 64 and the cleaner 65 and forms a process cartridge 66. The process cartridge 66 is detachably attached to the image forming apparatus 60 constituting a housing of a printer.

A cooling fan 77 is provided in the image forming apparatus 60. This cooling fan 77 is rotated as appropriate and takes in an outside air into the image forming apparatus 60 and cools a temperature rise spot such as the image forming portion and an electric equipment substrate. In the vicinity of the cooling fan 77, an environment detecting member 78 is provided and detects a temperature/humidity of an environment where the image forming apparatus is installed when the air outside the apparatus is taken in by the cooling fan 77. Then, a detection result is fed back to a temperature control sequence of the heat fixing apparatus 74.

On the sheet stacking table 68*a* of the feeding cassette 68, a movable regulating guide (not shown) for loading various recording materials with different sizes is provided. The regulating guide is displaced according to the size of the recording material P and the recording material P is loaded on the stacking table 68*a* so that various recording materials with different sizes can be picked up from the feeding cassette 68 one by one by the feeding roller 69.

The image forming apparatus of this embodiment is an image forming apparatus for A4-size sheet and its print speed is 63 sheets/minute (A4 size).

(2) Between Transfer Nip Portion/Fixing Nip Portion

Subsequently, by referring to FIG. 2, constitution between the transfer nip portion N1 and the fixing nip portion N2 will be described. The basic constitution in FIG. 2 is similar to that in FIGS. 8A and 8B used for a problem of the background art.

The transfer nip portion N1 is a portion for conveying the recording material P while transferring the toner image borne by the photosensitive drum 61 as the image bearing member to the recording material P as described above. Moreover, the fixing nip portion N2 is a portion disposed on a downstream side in the conveyance direction of the recording material with respect to the transfer nip portion N1 and fixing the toner image on the recording material P while sandwiching/conveying the recording material P.

Figure 8A:
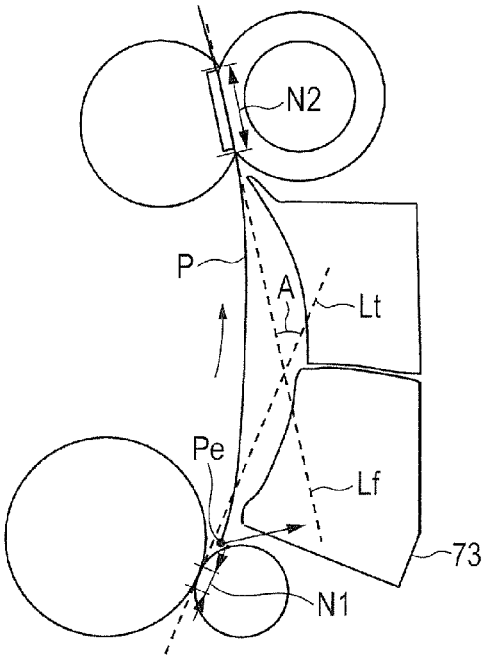
FIGS. 8A and 8B are behavior explanatory views of a recording material trailing edge between the transfer nip portion and the fixing nip portion for describing a problem of the present invention.
Figure 8B:
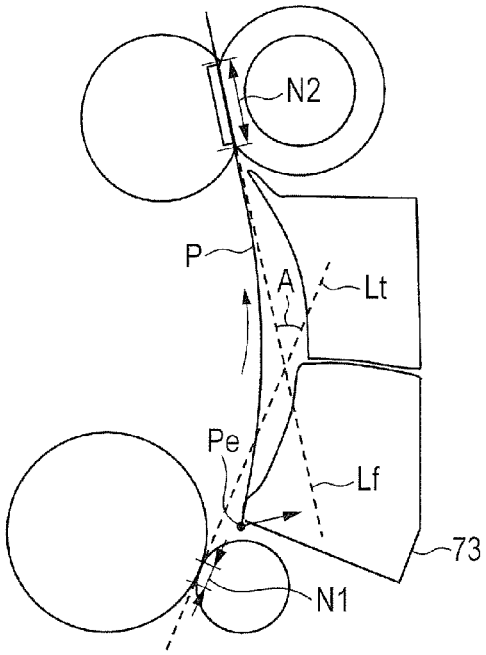

Between the transfer nip portion N1 and the fixing nip portion N2, the conveyance guide 73 and a fixing inlet guide 79 are provided as guide members for guiding the recording material P to the fixing nip portion N2. The conveyance guide 73 is disposed on an outlet side of the transfer nip portion N1 and guides the recording material P separated from the transfer nip portion N1 smoothly to a fixing nip inlet. Moreover, the conveyance guide 73 and the fixing inlet guide 79 are formed having a gentle curved shape so that, if a loop is formed in the recording material P between the transfer nip portion N1 and the fixing nip portion N2, the curved recording material can be accommodated. As illustrated in FIGS. 8A and 8B, the transfer nip portion N1 and the fixing nip portion N2 is made closer to each other in order to promote size reduction. The angle A formed by the nip tangential line Lt of the transfer nip portion N1 and the nip tangential line Lf of the fixing nip portion N2 is made larger so that even the curled recording material P can be stably introduced to the fixing nip portion N2. By constituting as above, the recording material leading edge can follow the conveyance guide 73 and the fixing inlet guide 79 more easily, and the recording material leading edge can be stably introduced to the fixing nip portion N2.

Figure 3A:
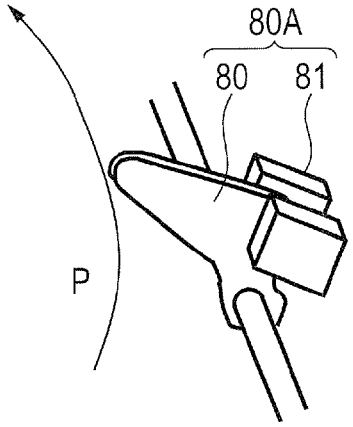
FIGS. 3A and 3B are schematic views of a loop detection flag and a loop detection sensor of the image forming apparatus according to the embodiment.
Figure 3B:
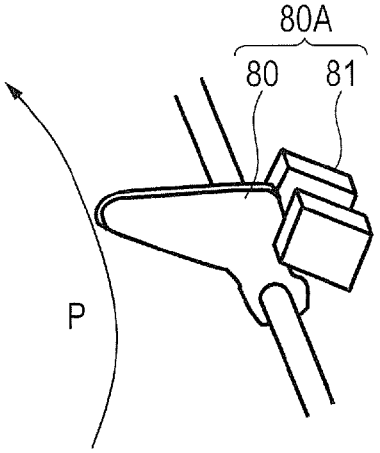

On a conveyance surface of this conveyance guide 73, as illustrated in FIGS. 3A and 3B, a loop amount detection mechanism 80A as the loop amount detection device is provided. This loop amount detection mechanism 80A detects a loop amount formed in the recording material P when the recording material P is conveyed in a state sandwiched by both the transfer nip portion N1 and the fixing nip portion N2.

The loop amount detection mechanism 80A includes a loop detection flag 80 and a loop detection sensor 81. The loop detection flag 80 includes a rod-shaped member capable of swing around its one end as a center, and the other end is disposed so as to protrude to the conveyance surface of the conveyance guide 73. The loop detection flag 80 is urged by a spring member (not shown) and swings according to the loop amount formed in the recording material P. The one end of the loop detection flag 80 shuts down/opens a detection position S (optical path) of the loop detection sensor 81 having a photo-interrupter for detecting whether the loop amount of the recording material P has exceeded a predetermined value or not. That is, the loop detection sensor 81 performs turning on/off according to a swing motion of the loop detection flag 80.

The loop amount is a distance between the loop (curved portion) formed by the recording material P between the transfer nip portion N1 and the fixing nip portion N2 and the conveyance guide 73. By slowing the conveyance speed of the fixing nip portion N2 than the conveyance speed of the transfer nip portion N1, the loop amount (curved amount) increases, while by quickening the conveyance speed of the fixing nip portion N2 than the conveyance speed of the transfer nip portion N1, the loop amount decreases. A loop amount Lmin which is a minimum, here, indicates a state where the recording material P is tensed as a straight line between the transfer nip portion N1 and the fixing nip portion N2. Moreover, a loop amount Lmax which is a maximum indicates that the loop formed by the recording material P between the transfer nip portion N1 and the fixing nip portion N2 becomes larger, and a part of the recording material P is in contact with the conveyance guide 73 or the fixing inlet guide 79.

(3) Loop Control

Figure 4:
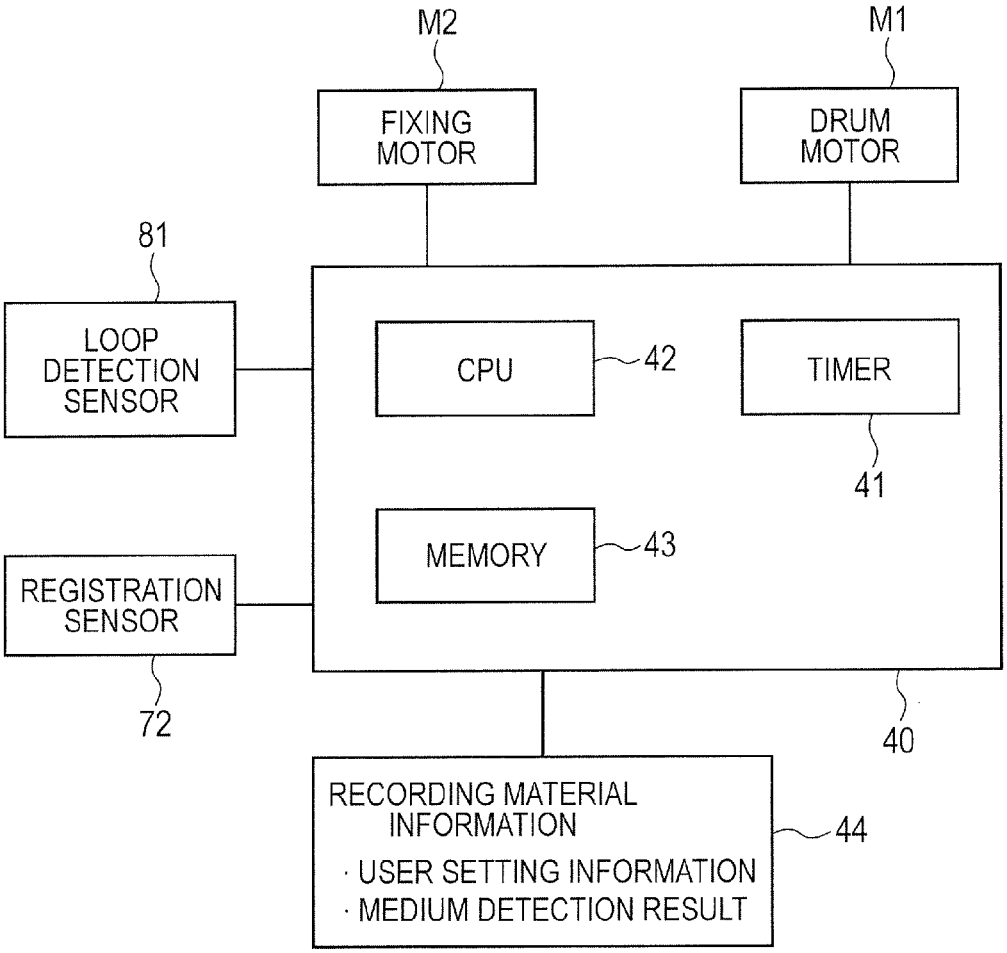
FIG. 4 is a block diagram of a control system of the image forming apparatus according to the embodiment.

Subsequently, by referring to FIG. 4, a control system of the loop detection control in this embodiment will be described. FIG. 4 is a block diagram illustrating the control system in this embodiment.

A control portion 40 provided in the image forming apparatus 60 has a timer 41, a CPU 42 and a memory 43. To the control portion 40, the registration sensor 72 as a timing detection device, the loop detection sensor 81 and a fixing motor M2 are connected.

The registration sensor 72 is disposed on an upstream side in the conveyance direction of the recording material P with respect to the transfer nip portion N1 and detects passage timing of the recording material P. The timer 41 counts each of timing required for control of the control portion 40. The CPU 42 executes various calculations required for control of the control portion 40. The memory 43 records recording material information and information required for control of passage timing of leading/trailing edge of the recording material P detected by the registration sensor 72.

Into the control portion 40, information relating to rigidity of the recording material P, that is, the recording material information on a size or a weight (basic weight) is input by a user from an information input portion 44 provided in the image forming apparatus 60 or by detection information from a detection device, not shown.

The control portion 40 determines whether the conveyed recording material P is a recording material with high rigidity or a recording material with low rigidity with respect to a reference determined in advance from the recording material information input from the information input portion 44. In this embodiment, the recording material information is information on the basic weight of the recording material P, and it is determined that, if the basic weight is at a value determined in advance or more, the recording material has high rigidity, while if the basic weight is less than the value determined in advance, the recording material has low rigidity.

That is, based on the input information on the weight (basic weight) of the recording material P, it is determined whether the conveyed recording material P is (1) a recording material with low rigidity "thin paper/ordinary paper" or (2) a recording material with high rigidity "cardboard". In this embodiment, the recording material P with the basic weight less than 90 (g/m$^2$) is determined to be (1) the recording material P with low rigidity "thin paper/ordinary paper" and the recording material P with the basic weight at 90 (g/m$^2$) or more is determined to be (2) the recording material with high rigidity "cardboard". However, in this embodiment, a threshold value of the basic weight used for determination between the "thin paper/ordinary paper" and the "cardboard" is set to 90 (g/m$^2$), but this is not limiting.

Moreover, even if the basic weight is the same, stiffness is different and thus, a type of the recording material maybe also included as information so as to have basic weight information according to type.

Subsequently, the loop control will be described by using FIGS. 2 and 4.

Basic control in the control portion 40 is such that the conveyance speed of the recording material at the fixing nip portion N2 is controlled with respect to the conveyance speed of the transfer nip portion N1, and the loop amount of the recording material P is maintained within a predetermined range based on a detection signal of the loop amount detection mechanism 80A.

The photosensitive drum 61 and the transfer roller 67 are rotated/drive by a drum motor M1. The transfer roller 67 may perform driven rotation by a friction force with the photosensitive drum 61. The pressure roller 82 of the heat fixing apparatus 74 is driven by a fixing motor M2, and a fixing film 83 is driven/rotated by the friction force with the pressure roller 82. The drum motor M1 and the fixing motor M2 are driven/controlled by the CPU 42, respectively.

Here, the CPU 42 drives the photosensitive drum and the transfer roller 67 so that the recording material P is conveyed at a predetermined conveyance speed v0 (mm/s) at the transfer nip portion N1. Moreover, the CPU 42 controls a conveyance speed v (mm/s) at the fixing nip portion N2 by switching a rotating speed of the fixing motor M2 in order to maintain the loop amount of the recording material P between the transfer nip portion N1 and the fixing nip portion N2 within a predetermined range.

Specifically, the conveyance speed v of the recording material P at the fixing nip portion N2 is controlled by switching to either one of a rotation numbers R1 and R2 of the fixing motor M2 according to the detection signal of the loop detection sensor 81. An outer diameter of the pressure roller 82 is largely changed by a type of the recording material P, a sheet passage situation, thermal expansion according to environment temperature and solid variation. Considering all the aforementioned variations in the outer diameter of the pressure roller 82, the rotation number R1 of the fixing motor M2 is a rotation number at which the conveyance speed v of the recording material P at the fixing nip portion N2 is faster than the conveyance speed v0 at the at the transfer nip portion N1. The conveyance speed of the recording material P at the fixing nip portion N2 at this time is assumed to be v1 (mm/s). Moreover, considering all the aforementioned variations in the outer diameter of the pressure roller 82, the rotation speed R2 of the fixing motor M2 is a rotation number at which the conveyance speed v of the recording material P at the fixing nip portion N2 is slower than the conveyance speed v0 at the transfer nip portion N1. The conveyance speed of the recording material P at the fixing nip portion N2 at this time is assumed to be v2 (mm/s). As described above, by controlling the rotation speed of the fixing motor M2 by R1 and R2 according to the detection signal of the loop detection sensor 81, the loop amount of the recording material P can be controlled.

(3-1) Loop Control of Thin Paper

Figure 5A:
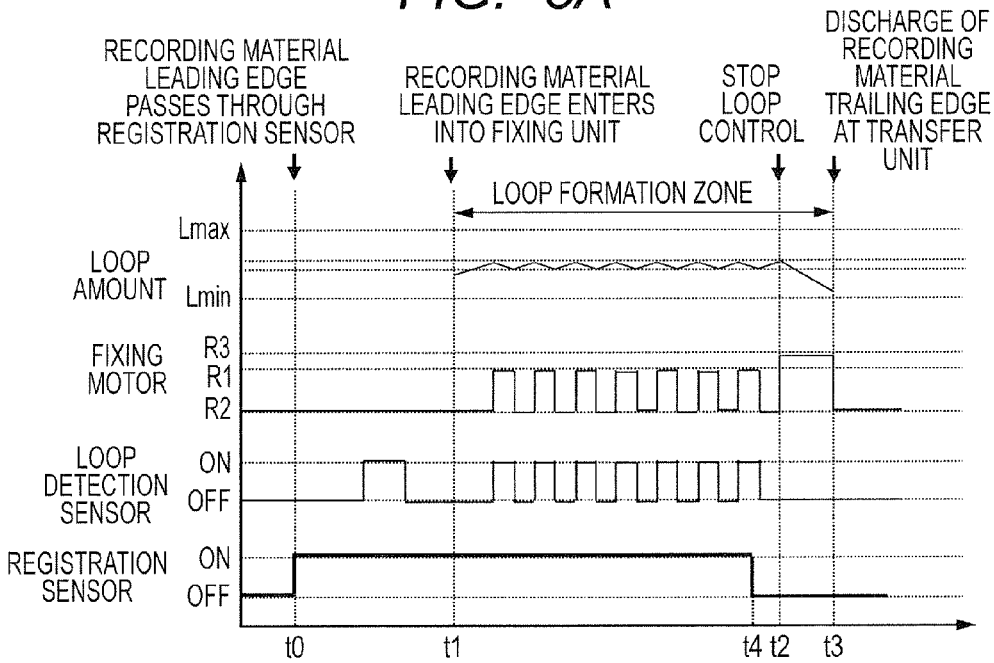
FIGS. 5A and 5B are timing charts illustrating fixing motor control of the image forming apparatus according to the embodiment.
Figure 6A:
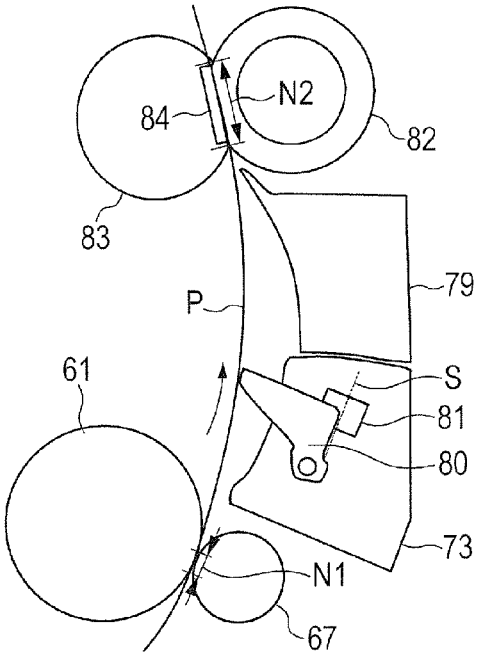
FIGS. 6A, 6B and 6C are explanatory views of an attitude of paper during conveyance of thin paper/ordinary paper of the image forming apparatus according to the embodiment.
Figure 6B:
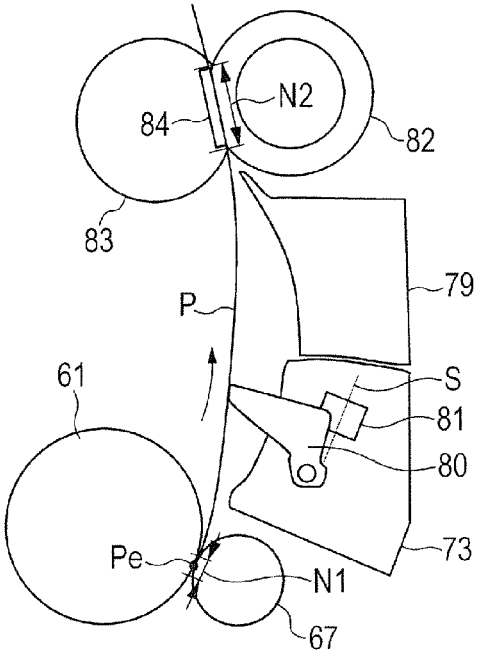
Figure 6C:
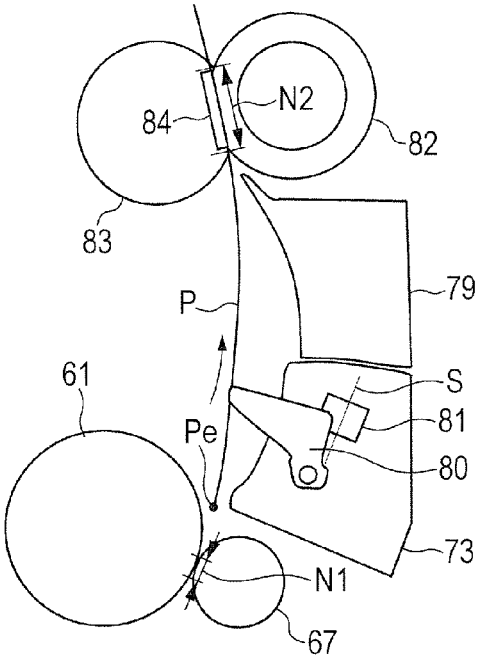

The loop control when the CPU 42 determines that the conveyed recording material P is the "thin paper/ordinary paper" by the information input portion 44 will be described by referring to FIGS. 5A and 6A to 6C. FIG. 5A is a timing chart of rotation speed switching control of the fixing motor M2 in sheet feeding of the thin paper/ordinary paper. FIGS. 6A to 6C illustrate attitudes of the recording material at each timing when the thin paper/ordinary paper is fed.

That is, when the thin paper/ordinary paper is to be fed, for a predetermined period after a leading edge of the recording material P reaches the fixing nip portion N2, the loop amount is maintained within a predetermined range. During this loop formation zone (loop formation period), the conveyance speed of the fixing nip portion N2 is controlled to the loop amount that the recording material P does not touch the conveyance guide 73.

Then, after the loop formation zone has elapsed and finished, before the trailing edge Pe of the recording material P exits out the transfer nip portion N1, the conveyance speed of the fixing nip portion N2 is increasingly controlled so that the recording material P does not touch the guide member between the loop detection sensor 81 and the transfer nip portion N1.

This timing at which the conveyance speed of the fixing nip portion N2 in increasingly-controlled is set after predetermined time has elapsed since registration sensor 72 detected passage of the leading or trailing edge of the recording material P.

More specific description will be given below.

After the leading edge of the recording material P has passed through the registration sensor 72 (=t0), the loop control is started at t1 when it enters into the fixing nip portion N2. Immediately after the recording material P has entered into the fixing nip portion N2, the loop amount formed by the recording material is small and thus, the loop detection flag 80 does not shield the detection position S of the loop detection sensor 81, and the loop detection sensor 81 detects an OFF state. The CPU 42 sets the rotation number of the fixing motor M2 to R2 in order to increase the loop amount. Since the conveyance speed v2 by the rotation number R2 at the fixing nip portion N2 is slower than the conveyance speed v0 at the transfer nip portion N1, the loop amount gradually increases. When the loop amount increases, the loop detection flag 80 shields the detection position S of the loop detection sensor 81. Then, since the loop detection sensor detects an ON state, the CPU 42 switches the rotation number of the fixing motor M2 to R1. Since the conveyance speed v1 at the fixing nip portion N2 corresponding to the rotation number is faster than the conveyance speed v0 at the transfer nip portion N1, the loop amount decreases. By repeating the above, one end of the loop detection flag 80 can keep the vicinity of the detection position S of the loop detection sensor 81 as illustrated in FIG. 6A, and the loop of the recording material P can be stably formed.

Then, the CPU 42 sets t2 at which the loop control is stopped at timing before the trailing edge Pe of the recording material P exits out the transfer nip portion N1 based on the size information of the recording material P and the passage information of the leading/trailing edge of the recording material P by the registration sensor 72. When this set t2 is reached, the CPU 42 stops the loop control and sets the rotation number of the fixing motor M2 to R3. This rotation number R3 is set to such a rotation number that a conveyance speed v3 (mm/s) of the fixing nip portion N2 becomes larger than the conveyance speed v0 at the transfer nip portion N1. Moreover, t1 and R3 are set to such a degree that the loop amount does not become Lmin.

Here, the rotation number R3 may be a rotation number at a fixed value. However, the outer diameter of the pressure roller 82 which is a roller constituting the fixing nip portion N2 is changed by the thermal expansion or the like. Thus, in order to stabilize the loop amount at a moment when the recording material trailing edge Pe exits out the transfer nip portion N1, the rotation number R3 changing according to the outer diameter of the pressure roller 82 can be used. For example, a rotation number R0 at which the conveyance speed v at the fixing nip portion N2 becomes substantially equal to the conveyance speed v0 at the transfer nip portion N1 may be calculated from a duty ratio of each of the rotation numbers R1 and R2 of the fixing motor M2 during the loop control zone, and a rotation number obtained by increasing R0 by a certain ratio may be used as R3.

Moreover, selection may be made such that a temperature of the pressure roller 82 is detected, the outer diameter of the pressure roller 82 is predicted from that, and the rotation number R3 is selected so that the conveyance speed v at the fixing nip portion N2 is faster than the conveyance speed v0 at the transfer nip portion N1 only by a predetermined speed. By using the rotation number R3 of the fixing motor M2 as above, the thermal expansion of the pressure roller 82 becomes less influential, and a behavior of the recording material trailing edge can be stabilized.

By executing acceleration control as above, the loop amount at the moment (=t3, FIG. 6B) when the recording material trailing edge Pe exits out the transfer nip can be made smaller than the loop amount during the loop control zone (FIG. 6A). As a result, the defective image caused by bouncing of the recording material trailing edge at the moment when the recording material trailing edge Pe exits out the transfer nip portion N1 (FIG. 6C) can be suppressed.

(3-2) Loop Control of Cardboard

Figure 5B:
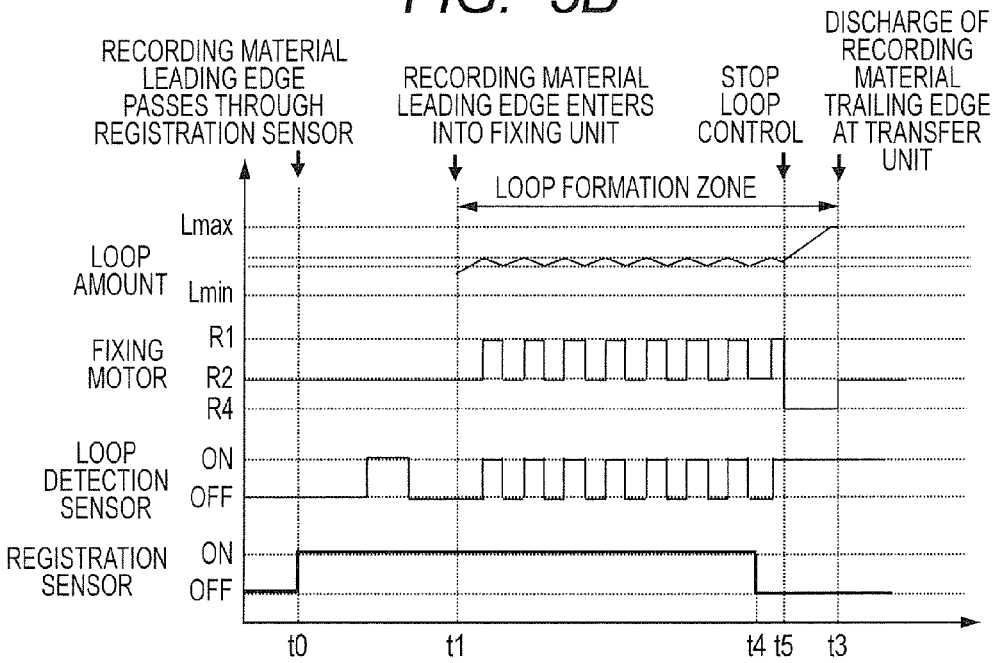
Figure 7A:
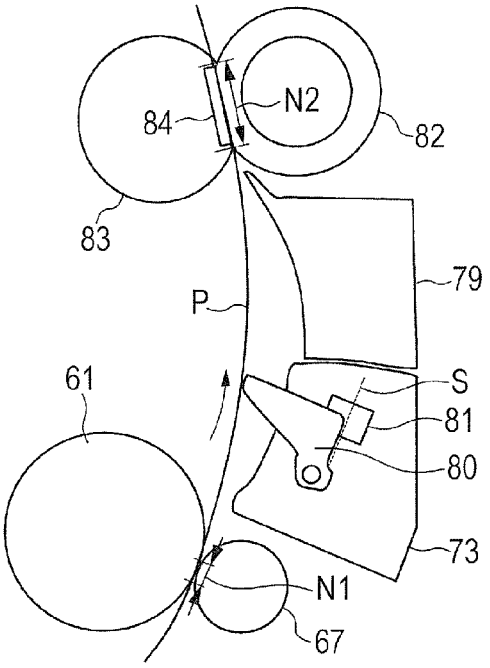
FIGS. 7A, 7B and 7C are explanatory views of an attitude of paper during conveyance of a cardboard of the image forming apparatus according to the embodiment.
Figure 7B:
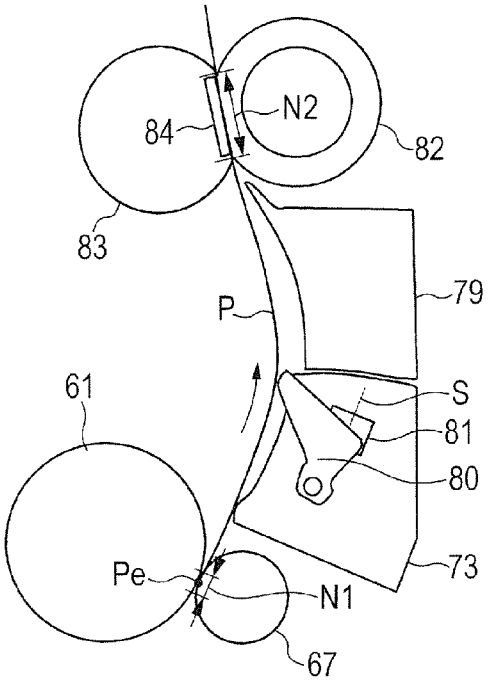
Figure 7C:
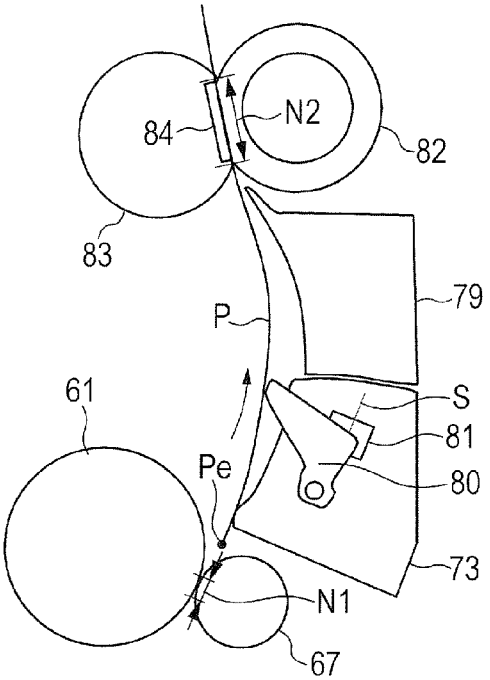

Subsequently, the loop control when the CPU 42 determines that the conveyed recording material is (2) the "cardboard" based on the recording material information input from the information input portion 44 will be described by referring to FIGS. 5B, 7A, 7B and 7C. FIG. 5B is a timing chart of rotation speed switching control of the fixing motor M2 in sheet feeding of the cardboard. FIGS. 7A, 7B and 7C illustrate attitudes of the recording material at each timing when the cardboard is fed.

The control portion 40 executes a mode for the cardboard when the conveyed recording material is a recording material with high rigidity based on the reference determined in advance, that is, the cardboard from the recording material information input from the information input portion 44.

That is, when the cardboard is to be fed, for a predetermined period after the leading edge of the recording material P reaches the fixing nip portion N2, the loop amount is maintained within a predetermined range. During this loop formation zone, the conveyance speed of the fixing nip portion N2 is controlled to the loop amount that the recording material P does not touch the conveyance guide 73. This loop formation zone is the same as that of the thin paper or the ordinary paper.

Then, after the loop formation zone has elapsed, before the trailing edge Pe of the recording material P exits out the transfer nip portion N1, the conveyance speed of the fixing nip portion N2 is decreased so as to increase the loop amount of the recording material P so that a part of the recording material P touches the conveyance guide 73. A position of contact with the conveyance guide 73 is set so that the contact is made on an upstream side in the conveyance direction of the recording material P than the loop detection sensor 81.

The timing when the control portion 40 executes deceleration control of the conveyance speed of the fixing nip portion N2 before the trailing edge Pe of the recording material P exits out the transfer nip portion N1 is set to time after predetermined time has elapsed since the registration sensor 72 detected passage of the leading edge or the trailing edge of the recording material P.

More specific description will be given below.

In the case of the cardboard, the CPU 42 sets t5 when the loop control is stopped at timing before the trailing edge Pe of the recording material P exits out the transfer nip portion N1 based on the size information of the recording material P and the passage information (=t0) of the leading edge of the recording material P by the registration sensor 72. The CPU 42 executes the loop control equivalent to that from t1 when the recording material leading edge enters into the fixing nip portion N2 to t2 when the loop control is stopped in feeding of the "thin paper/ordinary paper" until this set t5 is reached (FIG. 7A).

When the predetermined timing t5 is reached, the CPU 42 stops the loop control and changes the rotation number of the fixing motor M2 to a rotation number R4 so that a conveyance speed v4 of the fixing nip portion N2 becomes slower than the conveyance speed v0 of the transfer nip portion N1. For the timing t5 and for the rotation number R4 of the fixing motor M2, such values that the loop amount becomes Lmax, that is, a part of the recording material touches the conveyance guide 73 at the moment when the trailing edge Pe of the recording material P exits out the transfer nip portion N1 (=t3, FIG. 7B) is set.

Here, the rotation number R4 of the fixing motor M2 may be a fixed value but a rotation number changing according to the thermal expansion of the pressure roller can be used equally to the rotation number R3 in conveyance of the "thin paper/ordinary paper". In more detail, the rotation number R4 such that the conveyance speed v of the fixing nip portion N2 becomes slower than the conveyance speed v0 of the transfer nip portion N1 only by a predetermined speed can be used by using a duty ratio of the rotation numbers R1 and R2 of the fixing motor M2 during the loop control period and a detection result of the pressure roller temperature. By using such rotation number R4, the thermal expansion of the pressure roller becomes less influential, and a part of the recording material P can be stably brought into contact with the conveyance guide 73.

This deceleration control is to suppress occurrence of a defective image caused by the recording material trailing edge Pe slapped onto the conveyance guide 73 in order to solve the loop by a strong force by the high rigidity of the cardboard immediately after the recording material trailing edge Pe exits out the transfer nip portion N1. By means of the aforementioned deceleration control, a part of the recording material P touches the conveyance guide 73 at the moment when the recording material trailing edge Pe exits out the transfer nip portion N1 (=t3, FIG. 7B). Thus, since the recording material P cannot rapidly change the attitude any more by using its contact point as a fulcrum even after the recording material trailing edge Pe exits out the transfer nip portion N1 (FIG. 7C), the recording material trailing edge Pe can smoothly land on the conveyance guide 73.

Thus, a position of the conveyance guide 73 touched by a part of the recording material P at the moment when the recording material P exits out the transfer nip portion N1 can be closer to the transfer nip portion N1 as much as possible, and the conveyance guide 73 and the like are designed so that the contact is made on the upstream side from the loop detection flag 80.

As described above, in conveyance of the "thin paper/ordinary paper", the recording material P is conveyed so as not to touch the conveyance guide 73 while forming a loop at the transfer nip portion N1 and the fixing nip portion N2. On the other hand, in conveyance of the "cardboard", conveyance is carried out so that the recording material trailing edge Pe touches a part of the conveyance guide 73 immediately before exiting out the transfer nip portion N1. By controlling the attitude when the recording material trailing edge Pe exits out the transfer nip portion N1 as above according to the weight (basic weight) of the recording material P, the behaviors of the recording material trailing edge Pe of the "thin paper/ordinary paper" and the "cardboard" can be controlled, respectively, and the defective image can be prevented.

In this embodiment, an apparatus having the endless belt-shaped fixing film 83, the heater 84 in contact with an inner surface of the fixing film 83 and the pressure roller 82 forming the fixing nip portion N2 together with the heater 84 through the fixing film 83 is illustrated as the heat fixing apparatus 74. However, the heat fixing apparatus is not limited to that as long as a rotary body driven by the fixing motor M2 is constituted to have an elastic layer and this rotary body is heated and the elastic layer causes thermal expansion. For example, it may be an apparatus having an endless belt-shaped fixing film, a heater contained by the fixing film and heating an inner surface of the fixing film by radiant heat, a nip-portion forming member in contact with the inner surface of the fixing film and a pressure roller forming the nip portion together with the nip-portion forming member through the fixing film. Moreover, it may be an apparatus having a self-heating endless belt-shaped belt, a nip-portion forming member in contact with an inner surface of the endless belt-shaped film and a pressure roller forming a nip portion together with the nip-portion forming member through the film.

Moreover, in this embodiment, the timings t2 and t5 when the loop control is stopped are described by using a method of calculating them by using passage timing of the recording material leading edge by the registration sensor 72 as a starting point, but they may be calculated by using passage timing of the recording material trailing edge Pe by the registration sensor 72 as a starting point.

Moreover, in this embodiment, a monochromic image forming apparatus using a process cartridge is described, but a color image forming apparatus using an intermediate transfer belt or transfer conveyance belt type may be also used.

Moreover, in this embodiment, the loop amount of the recording material P is detected by combining the loop detection flag 80 and the loop detection sensor 81, but a unit for detecting the loop amount is not limited to that, but an optical sensor may be used to detect the loop amount, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-020762, filed Feb. 5, 2016, which is hereby incorporated by reference herein in its entirety.

What is claimed is:

1. An image forming apparatus comprising:

an image bearing member;

a transfer member forming a transfer nip portion together with the image bearing member and transferring a toner image borne by the image bearing member onto a recording material while the recording material is conveyed at the transfer nip portion;

a fixing unit disposed on a downstream side in a conveyance direction of the recording material with respect to the transfer nip portion and fixing the toner image onto the recording material while the recording material is sandwiched and conveyed at the fixing nip portion;

a guide member provided between the transfer nip portion and the fixing nip portion and guiding the recording material to the fixing nip portion;

a loop amount detection device provided between the transfer nip portion and the fixing nip portion and detecting a loop amount of the recording material in a state where the recording material being conveyed strides over both the transfer nip portion and the fixing nip portion; and a control portion for controlling a conveyance speed of the recording material at the fixing nip portion based on a detection signal of the loop amount detection device, the control portion controlling the conveyance speed of the recording material at the fixing nip portion so that the loop amount of the recording material is maintained within a predetermined range, wherein during a period after an operation for maintaining the loop amount of the recording material being conveyed within the predetermined range is finished and until a recording material trailing edge exits out the transfer nip portion, the control portion controls the conveyance speed of the recording material at the fixing nip portion so that a part of the recording material touches the guide member between the transfer nip portion and the loop detection device.

2. An image forming apparatus according to claim 1, wherein the control portion executes control for decreasing the conveyance speed of the recording material at the fixing nip portion so that a part of the recording material touches the guide member between the transfer nip portion and the loop detection device for a period until a recording material trailing edge exits out the transfer nip portion if rigidity of the recording material is higher than a reference value, and control for increasing the conveyance speed at the fixing nip portion so that the recording material does not touch the guide member between the transfer nip portion and the loop detection device for the period until a recording material trailing edge exits out the transfer nip portion if rigidity of the recording material is lower than the reference value.

3. An image forming apparatus according to claim 1, wherein the control portion executes control for decreasing the conveyance speed of the recording material at the fixing nip portion so that a part of the recording material touches the guide member between the transfer nip portion and the loop detection device for a period until a recording material trailing edge exits out the transfer nip portion if a basic weight of the recording material is larger than a reference value, and control for increasing the conveyance speed at the fixing nip portion so that the recording material does not touch the guide member between the transfer nip portion and the loop detection device for the period until a recording material trailing edge exits out the transfer nip portion if the basic weight of the recording material is smaller than the reference value.

4. An image forming apparatus according to claim 1, wherein the predetermined range is set so that the recording material does not touch the guide member.

5. An image forming apparatus according to claim 1, wherein the apparatus is constituted so that a nip tangential line of the transfer nip portion and a nip tangential line of the fixing nip portion cross each other.

6. An image forming apparatus according to claim 1, wherein the fixing unit has an endless-shaped fixing film and a pressure roller in contact with an outer surface of the fixing film and forming the fixing nip portion between itself and the fixing film.

7. An image forming apparatus according to claim 6, wherein the fixing unit further has a heater in contact with an inner surface of the fixing film.

8. An image forming apparatus according to claim 7, wherein the fixing nip portion is formed by applying a pressure between the heater and the pressure roller through the fixing film.

9. An image forming apparatus comprising:

an image bearing member;

a transfer member forming a transfer nip portion together with the image bearing member and transferring a toner image borne by the image bearing member onto a recording material while the recording material is conveyed at the transfer nip portion;

a fixing unit disposed on a downstream side in a conveyance direction of the recording material with respect to the transfer nip portion and fixing the toner image onto the recording material while the recording material is sandwiched and conveyed at the fixing nip portion;

a guide member provided between the transfer nip portion and the fixing nip portion and guiding the recording material to the fixing nip portion;

a loop amount detection device provided between the transfer nip portion and the fixing nip portion and detecting a loop amount of the recording material in a state where the recording material being conveyed strides over both the transfer nip portion and the fixing nip portion; and a control portion for controlling a conveyance speed of the recording material at the fixing nip portion based on a detection signal of the loop amount detection device, the control portion controlling the conveyance speed of the recording material at the fixing nip portion so that the loop amount of the recording material is maintained within a predetermined range, wherein during a period after an operation for maintaining the loop amount of the recording material being conveyed within the predetermined range is finished and until a recording material trailing edge exits out the transfer nip portion, the control portion decreases the conveyance speed of the recording material at the fixing nip portion.

10. An image forming apparatus according to claim 9, wherein the control portion executes control for decreasing the conveyance speed of the recording material at the fixing nip portion so that a part of the recording material touches the guide member between the transfer nip portion and the loop detection device for a period until a recording material trailing edge exits out the transfer nip portion if rigidity of the recording material is higher than a reference value; and control for increasing the conveyance speed at the fixing nip portion so that the recording material does not touch the guide member between the transfer nip portion and the loop detection device for the period until a recording material trailing edge exits out the transfer nip portion if rigidity of the recording material is lower than the reference value.

11. An image forming apparatus according to claim 9, wherein the control portion executes control for decreasing the conveyance speed of the recording material at the fixing nip portion so that a part of the recording material touches the guide member between the transfer nip portion and the loop detection device for a period until a recording material trailing edge exits out the transfer nip portion if a basic weight of the recording material is larger than a reference value; and control for increasing the conveyance speed at the fixing nip portion so that the recording material does not touch the guide member between the transfer nip portion and the loop detection device for the period until a recording material trailing edge exits out the transfer nip portion if the basic weight of the recording material is smaller than the reference value.

12. An image forming apparatus according to claim 9, wherein the fixing unit has an endless-shaped fixing film and a pressure roller in contact with an outer surface of the fixing film and forming the fixing nip portion between itself and the fixing film.

13. An image forming apparatus according to claim 12, wherein the fixing unit further has a heater in contact with an inner surface of the fixing film.

14. An image forming apparatus according to claim 13, wherein the fixing nip portion is formed by applying a pressure between the heater and the pressure roller through the fixing film.

* * * * *